US007769700B1

(12) United States Patent
D'Amico et al.

(10) Patent No.: US 7,769,700 B1
(45) Date of Patent: Aug. 3, 2010

(54) METHOD AND APPARATUS FOR TRANSFERRING POST METER DATA

(75) Inventors: Lynn W. D'Amico, Higganum, CT (US); Derak DaGenarro, Prospect, CT (US); Wesley A. Kirschner, Hamden, CT (US); Roger J. Ratzenberger, Jr., Milford, CT (US); Vincent Rozendaal, Easton, CT (US)

(73) Assignee: Pitney Bowes Inc., Stamford, CT (US)

( * ) Notice: Subject to any disclaimer, the term of this patent is extended or adjusted under 35 U.S.C. 154(b) by 1709 days.

(21) Appl. No.: 10/604,783

(22) Filed: Aug. 15, 2003

Related U.S. Application Data

(60) Provisional application No. 60/319,473, filed on Aug. 15, 2002.

(51) Int. Cl.
*G07B 17/02* (2006.01)

(52) U.S. Cl. ..... 705/401

(58) Field of Classification Search ..... 705/401
See application file for complete search history.

(56) References Cited

U.S. PATENT DOCUMENTS

| | | | | | |
|---|---|---|---|---|---|
| 4,629,871 | A | * | 12/1986 | Scribner et al. | 235/375 |
| 4,752,950 | A | | 6/1988 | Le Carpentier | |
| 4,811,234 | A | | 3/1989 | Storace | |
| 4,813,802 | A | | 3/1989 | Gilham et al. | |
| 4,928,249 | A | | 5/1990 | Vermesse | |
| 4,980,542 | A | | 12/1990 | Jackson et al. | |
| 5,005,124 | A | | 4/1991 | Connell et al. | |
| 5,280,531 | A | | 1/1994 | Hunter | |
| 5,323,323 | A | | 6/1994 | Gilham | |
| 5,383,115 | A | * | 1/1995 | Lecarpentier | 705/401 |
| 5,384,708 | A | | 1/1995 | Collins et al. | |
| 5,493,106 | A | | 2/1996 | Hunter | |
| 5,513,112 | A | | 4/1996 | Herring et al. | |
| 5,535,126 | A | | 7/1996 | Mourgues | |
| 5,675,650 | A | | 10/1997 | Cordery et al. | |
| 5,715,164 | A | * | 2/1998 | Liechti et al. | 705/410 |
| 5,717,596 | A | | 2/1998 | Bernard et al. | |
| 5,898,785 | A | * | 4/1999 | Cornell et al. | 380/51 |
| 6,112,193 | A | | 8/2000 | Dlugos et al. | |
| 6,148,292 | A | * | 11/2000 | Reisinger et al. | 705/30 |
| 6,208,980 | B1 | * | 3/2001 | Kara | 705/408 |
| 6,226,626 | B1 | * | 5/2001 | Thiel | 705/407 |
| 6,509,976 | B1 | | 1/2003 | Law et al. | |
| 6,650,433 | B1 | * | 11/2003 | Keane et al. | 358/1.15 |
| 2002/0161742 | A1 | | 10/2002 | Heiden et al. | |
| 2003/0083998 | A1 | * | 5/2003 | Ramachandran et al. | 705/59 |
| 2003/0097337 | A1 | * | 5/2003 | Brookner et al. | 705/60 |

FOREIGN PATENT DOCUMENTS

| | | | |
|---|---|---|---|
| WO | WO 00/52614 | * | 9/2000 |

OTHER PUBLICATIONS

Business Editors, "Francotyp-Postalia Launches KARAT Cost Accounting Program for Postage Meters in U.S.," Business Wire, New York, Nov. 2, 2000, p. 1.*

* cited by examiner

*Primary Examiner*—John W Hayes
*Assistant Examiner*—Nathan Erb
(74) *Attorney, Agent, or Firm*—George M. Macdonald; Angelo N. Chaclas

(57) ABSTRACT

A method and a system for collecting, segregating, and transmitting data relating to the use of a value metering system are described. A system and a method for dynamically updating collection, segregation, and/or transmission rules are also described.

10 Claims, 5 Drawing Sheets

METHOD AND APPARATUS FOR TRANSFERRING POST METER DATA

CROSS REFERENCE TO RELATED APPLICATIONS

This application claims priority under 35 U.S.C. section 119(e) from Provisional Patent Application Ser. No. 60/319,473, filed Aug. 15, 2002, entitled Postage Meter Usage Data Collection System And Method, which is incorporated herein by reference in its entirety.

BACKGROUND OF INVENTION

Value metering systems such as postage meters account for dispensed value. The systems may operate in a value infrastructure utilizing one or both of prepaid or postpaid value services. Mailing machines often contain several modules typically including a postage meter, scale and rating system that are used to process mail pieces. In one scenario, a user selects a class of service and uses the scale and rating engine of the mailing machine to determine the proper postage value. The mailing machine is then used to evidence and account for the dispensed postage amount.

Additionally, certain mailing machines include data connectivity for external devices including scales, accounting charge-back systems and postage data center connectivity for processing postage refills. Certain mailing machines may be used with meter usage data transmission systems.

Mailing machines such as the GALAXY™ Mailing System and PARAGON® II Mail Processor are available from Pitney Bowes Inc. of Stamford, Conn. POSTAGE BY PHONE® and ACCUTRAC™ also available from Pitney Bowes Inc. allow for postage meter refills and internal postage charge-back accounting, respectively. Certain postal system administrations require that some form of postage meter data be collected and forwarded to the post. Furthermore, the requirements for meter usage data collection and submission vary from one post to another.

SUMMARY OF INVENTION

Illustrative embodiments including systems and methods for data collection, segregation and transmission are described. In one illustrative embodiment, a value metering system includes a data collection system having data capture rules that may be dynamically updated utilizing information from an external source.

In another illustrative embodiment, a value metering system includes a data collection system for collecting data in generic data buckets that are tagged in defined fields. The generic data is then processed by a data segregation system for segregating data fields that are relevant for a particular application.

In an alternative embodiment, the segregation system is external from the value metering system. The external segregation system translates the segregated data according to translation rules in order to create translated data for transmission to a particular data upload destination such as the national postal system data center.

In another alternative embodiment, the data includes aggregated usage data. Collection rules are used to determine which meter usage modes are collected into a usage data bucket and collection rule parameters are used to determine collection periods and data upload transmission frequency.

In another illustrative embodiment, a value metering system includes a data collection system for transmitting collected data to an external processor. The data collection system stores at least a portion of the transmitted data. In an alternative, the value metering system is responsive to a request from the external processor for retransmission of the data.

DETAILED DESCRIPTION

Figure 1:
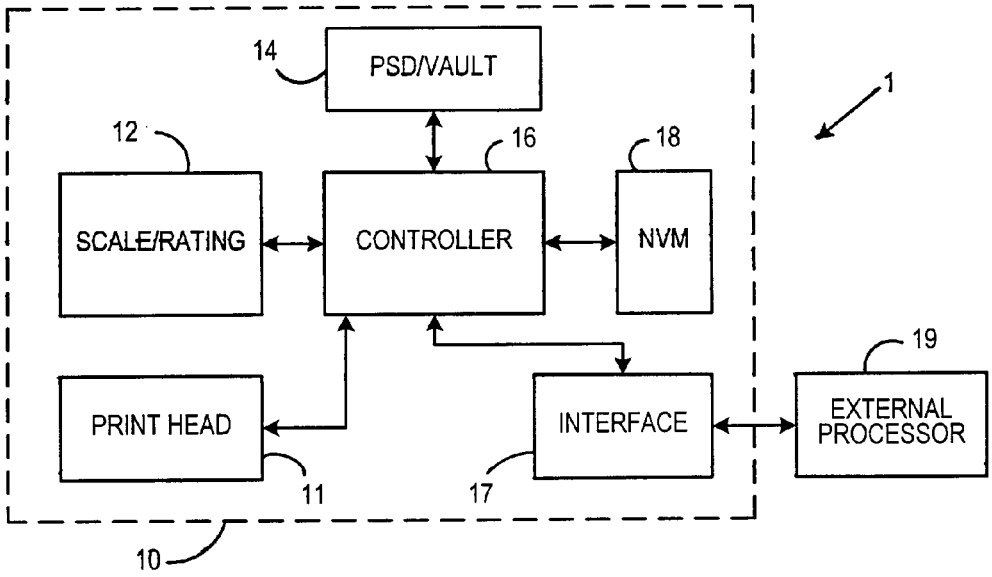
FIG. 1 is a block diagram illustrating a system for collecting meter usage data according to an illustrative embodiment of the present application.

Referring to FIG. 1, a value metering system having a system for collecting meter usage data 1 according to an illustrative embodiment of the application is described. A postage meter 10 includes a Postal Security Device (PSD)/Vault 14 for storing postage values and accounting for postage payment. The PSD/Vault 14 is connected to a controller 16. The controller 16 is also connected to a scale and rating engine 12. The controller 16 performs the rating engine processing. The Controller 16 is a microcontroller embedded into the postage meter 10. In alternative embodiments, the controller 16 is a processor such as a general-purpose microcomputer.

Alternative elements described are understood to be applicable to all embodiments described herein, but may be described with reference to only one embodiment in order to simplify the description.

Print head 11 is connected to controller 16 and produces indicia for evidencing payment of postage. Non-volatile memory (NVM) 18 stores meter usage data. Other memory devices (not shown) are included in the system and used for instruction memory and other data. The other memory devices include RAM and ROM memory, but in alternatives may also include flash memory, EE Prom memory, battery backed RAM or other memory device including magnetic, physical or optical media. Meter usage data may be stored in any of the available memory devices.

The PSD/Vault 14 is a secure device that is a cryptographic element of the meter. In this embodiment, the PSD/vault 14 performs all funds management and security functions. The PSD/Vault 14 generates cryptographic signatures that are used for postage authentication.

The Controller 16 is embedded in the mailing machine. In alternatives, the controller 16 may be resident in a user interface or mailing machine base and may have functions that are performed by one or more processors. The controller 16 coordinates all meter processing.

The non-volatile memory 18 provides storage for data and code that is static when power is removed from the system. The data includes data capture data including a data capture log. The scale/rating system 12 includes a Weigh on the Way (WOW) system for determining the weight of the mail. The determined weight information is used along with class of service information to determine the appropriate postage. In an alternative, other weighing and rating systems may be utilized including dimensional rating systems, direct entry of postage and automatic determination of best class of service to use. The rating engine determines the postage amount to be used based upon the input class of service or default class and the weight of the mail piece.

The print head 11 and print head controller are utilized to print an indicia image when the print head system receives a valid, properly signed debit record. The external interface 17 includes an analog modem suitable for connection to the telephone network. In an alternative, other interface protocols such as USB, IEEE-232, Ethernet and other communications channels may be utilized.

The external processor 19 is a meter manufacturer data center server. In an alternative, the external processor may be an external accounting device such as a charge-back system, a postal server or other suitable processor such as a personal computer.

In this embodiment, the data capture system is known as meter-centric in that the postage meter processes the data collection. The postage meter 10 performs data collection for each transaction. A typical transaction includes printing an indicia on an envelope or indicia tape. The meter 10 periodically transmits transaction batches to an accounting device such as the external processor 19.

The meter 10 uploads information to data center 19 in an upload mode and downloads information from the data center 19 in a download mode.

The upload information includes meter usage data captured by the meter 10 during operation. Alternatively, other data such as diagnostic, status or other captured information is transmitted. The meter usage data is organized into data buckets that contain information such as the total postal value, total weight and total number of mail pieces for each of the defined buckets that correspond to a particular category such as a class of service or a weight break in a class of service.

The number and types of buckets are defined in a set of segregation rules that are developed with reference to the appropriate postal authority data submission rules. A meter may be configured to operate in a number of countries and may be able to allow the user or other selection criteria including location to determine the appropriate segregations rules to use from among a group of segregation rule sets.

Both a number and name are used to identify the buckets and they are generally organized according to the rate structure of a particular postal system. The rate structure in a particular country typically includes various classes or class/special fee combinations. The captured data is periodically sent to the postal authority via the data center 19 in an uploading process. The data center 19 may aggregate the information from many meters before sending it to the postal authority and may translate the information into a common format used by the post.

The postal authority mandates a set of periods that are used to determine the data upload frequency. The meter may store such a frequency parameter in a data capture rule parameter memory location. In an alternative, the data center 19 may maintain data upload schedules and may query the meter 10 for the data.

When a data capture period has ended, the system halts normal mail processing operation and enters a data center upload mode in order to transmit the meter usage data and other system data to the data center. In an alternative, the system continues to process mail pieces using a second set of data capture buckets while the meter 10 concurrently processes the data upload of the first set of data for the expired data capture period. Upon successful upload, the buckets are reset. The meter usage data is formatted using an extensible Markup Language (XML) having a tag assigned to each field of each bucket.

In this embodiment, the segregation rules are obtained using information from the postal authority via download from the data center 19. The download may include other information including operating parameters. The rule and parameter transfer is done in a meter download mode from time to time on a schedule. Alternatively, the download mode may be event driven and occur when new rules become available. Similarly, both push and pull models may be used. The data center includes a process for matting the various post rules into a common form that the meter can utilize. The segregation rules and PCN parameters are formatted in an XML format.

Meter usage data is logged locally into the NVM 18 when each transaction record is sent to the print head controller during the indicia printing process. The scale 12 determines and transfers weight data to the rating engine 12. The rating engine 12 determines and transfers postage value data to the controller 16. The meter 10 determines the active segregation rule and active buckets based upon the rating information and weight data. The user initiates a mail run using either the scale 12 or the user interface (not shown). All postage data is sent to the PSD/Vault 14 for signature generation and the account debit calculation. The signed debit record is then sent to the controller 16. The controller 16 then sends the signed debit record to the print head and the print head controller 11 processes the record to print an indicia. The controller 16 increments the piece count for the active buckets based upon the data in the signed record. The meter usage data is then logged into the NVM 18.

When the meter usage data is to be transferred to the external processor 19, all records are retrieved from the NVM and transferred using interface 17. The transfer may be triggered by a user selection or by a determination that an accounting period is complete (automatic upload).

In this embodiment, the meter 10 collects details of every transaction over a period of time. The meter 10 includes memory location sufficient to store at least two periods of data and is able to securely transmit the data. The data capture rules are parameterized and the rules and parameters are capable of being remotely updated.

Figure 2:
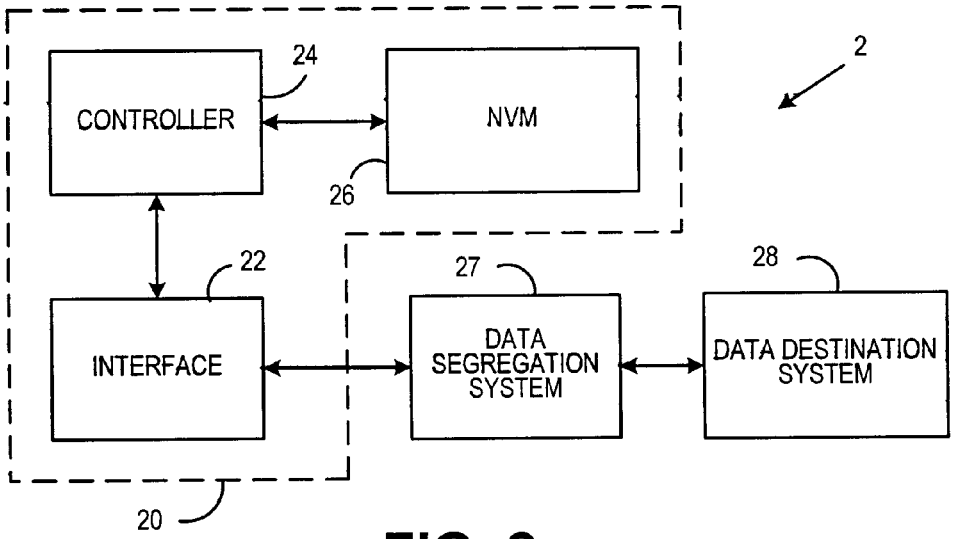
FIG. 2 is a block diagram illustrating a system for generically collecting meter usage data according to an illustrative embodiment of the present application.

Referring to FIG. 2, a method and system for generically transferring meter usage data according to another illustrative embodiment of the application is shown. A typical meter 20 is often of a model type used in more than one country. The postal authorities in each country typically have differing data capture requirements. In this embodiment, the meter does not require different software for each locality.

In this embodiment, the meter usage data capture system 2 uses a controller 24 connected to NVM 26 and interface 22 for connecting to the data segregation system 27. The data segregation system 27 is connected to the data destination system 28. In this illustrative embodiment, the data destination system is a postal authority server.

The data buckets used by the meter usage data capture system 2 are encapsulated using XML tags. The system 2 uses an XML interface as a generic interface that is used in each meter 20 regardless of the particular postal system in which it is used. The generic interface allows for generic data tags. The data segregation system 27 receives the XML encapsulated data bucket information and ignores data having tags that the particular relevant postal system does not require. The data segregation system 27 includes all country specific format information and translates the generic XML data into a format recognized by the particular post. In an alternative, the data segregation system 27 aggregates meter usage data for users of multiple meters. Accordingly, the meter 20 does not have to provide postal system/country specific format information.

The data segregation system 27 sends new XML formatted segregation rules and parameters to the meter 20 if a post updates its data capture requirements. The new rules are then applied to subsequent data uploads. In an alternative, the data segregation system 27 triggers a software update event when it receives data in an outdated format from a particular meter 20. In that situation, the data received in the obsolete format could be retained, reformatted or retransmitted by the meter after the software update.

Figure 3:
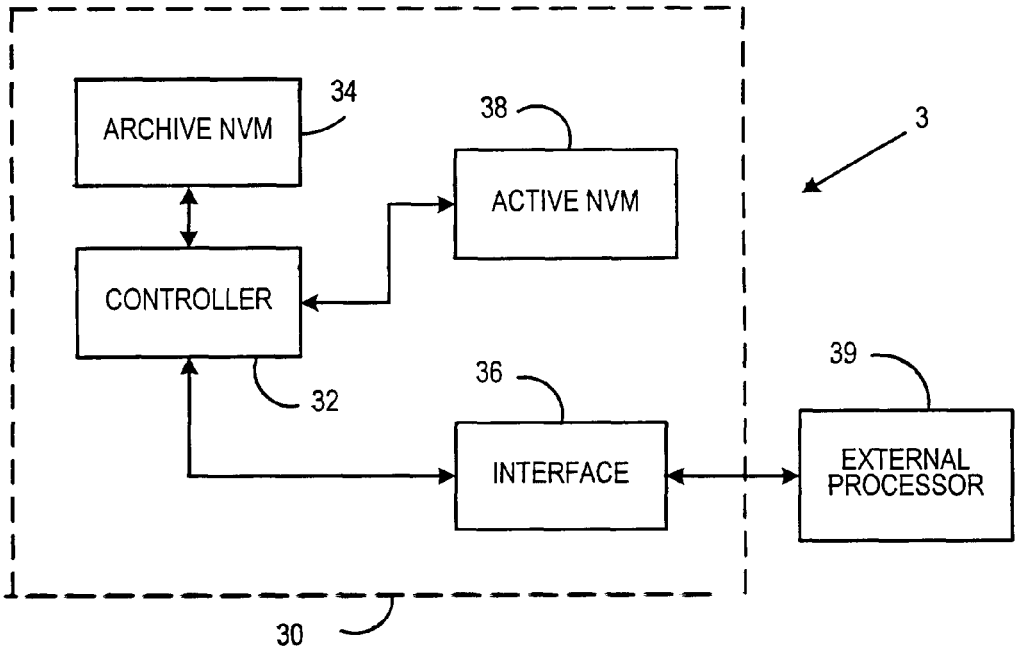
FIG. 3 is a block diagram illustrating a system for collecting and storing meter usage data according to an illustrative embodiment of the present application.

Referring to FIG. 3, a system for preserving meter usage data according to an illustrative embodiment of the application is described. Meter usage capture system 3 includes a meter 30 having a controller 32 connected to both an archive NVM 34 and active NVM 38. The controller is connected to interface 36 for communicating with external processor 39. In this embodiment, the external processor 39 is a meter manufacturer data center. Certain situations such as meter failures require that data must be recovered after the failure. For example, a meter display may fail, the meter may be retired from service, a critical meter component may fail or the data capture server fails. The archive NVM 34 allows such a data recovery.

In this embodiment, the active NVM 38 stores current period data that is sent to the external server. The current period data is also stored in the archive NVM 34. The archive NVM is preferably Flash memory because there are fewer write cycles to this back up device. The active NVM 38 is preferably battery backed CMOS as the memory includes counters and the data is comparatively more frequently written to those locations. The external interface 36 includes a Universal Asynchronous Receiver/Transmitter (UART) located in the controller. Alternatively, another communication device may be utilized. If the external processor 39 or destination server (not shown) fails, the meter 30 may be queried for the backed up data. Accordingly, the system permits data capture data recovery should a failure occur and can provide recovery when the external processor fails.

The communications channels described herein may utilize known security procedures including encryption, authentication and non-repudiation systems.

In an alternative, external scales and rating systems are used. Additionally, the meter may separate bucket information into weight categories. The weight categories may include electronically determined weights (e.g. using weight from a scale platform), dimensionally determined weights, and non-electronically determined (e.g. manually entered) postage values. The system also allows a variable parameter to determine whether the ability to manually enter postage values and/or add postage to rated postage values is enabled or disabled. Furthermore, the system may be configured to either require or not-require a class selection in a Manual Postage mode (i.e. Key In Postage).

In another alternative, the system provides the ability to place text string information in the downloaded Data Capture rules file. The text string information can be used as a versatile mechanism to print Data Capture related information in the indicia or to include the information in a generated barcode.

In a further alternative, the system provides a mechanism that allows different rules files to be downloaded to the Product (UIC) based on its segment type. A segment type is used to differentiate mailing system based on their projected usage patterns (e.g. how many average mail pieces per day are processed). The system provides a unique ID and timestamp on all uploaded Data Capture usage reports and is used to identify whether duplicate reports are being uploaded.

In another alternative, the system provides a roll-back strategy implemented to ensure that the data capture bucket data (i.e. sum of all postage values in all of the buckets) cannot deviate from the register values in the meter. The roll-back strategy prevents data capture errors even in if an exceptional error condition such as a power fail during the funds debiting and indicia printing process occurs.

In a further alternative, the system stores two sets of rates and rules files (active and future), each with an effectivity date that determines when the set is effective. Future rates and rules files are activated if the actual (calendar) date changes past an effectivity date or a customer advances the printed date beyond an effective date.

In another alternative, the system provides a base log that is uploaded with the data capture data that contains a list (by PCN/Model Number) of the last 10 bases that a particular data capture UIC is installed upon. In an alternative, the query can request another number of recent base installations.

Figure 4:
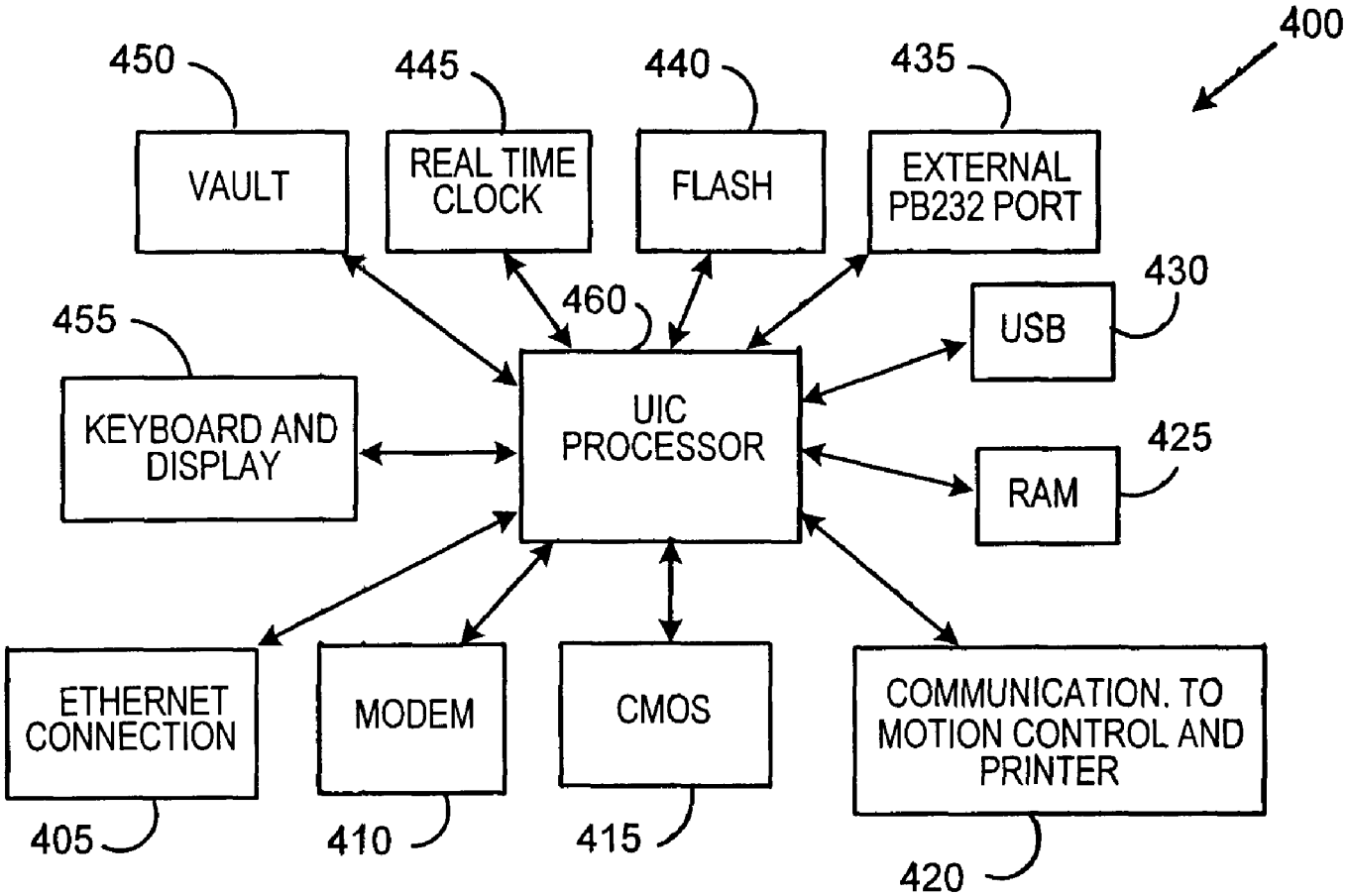
FIG. 4 is a block diagram illustrating a value metering system for collecting meter usage data according to an illustrative embodiment of the present application.
Figure 5:
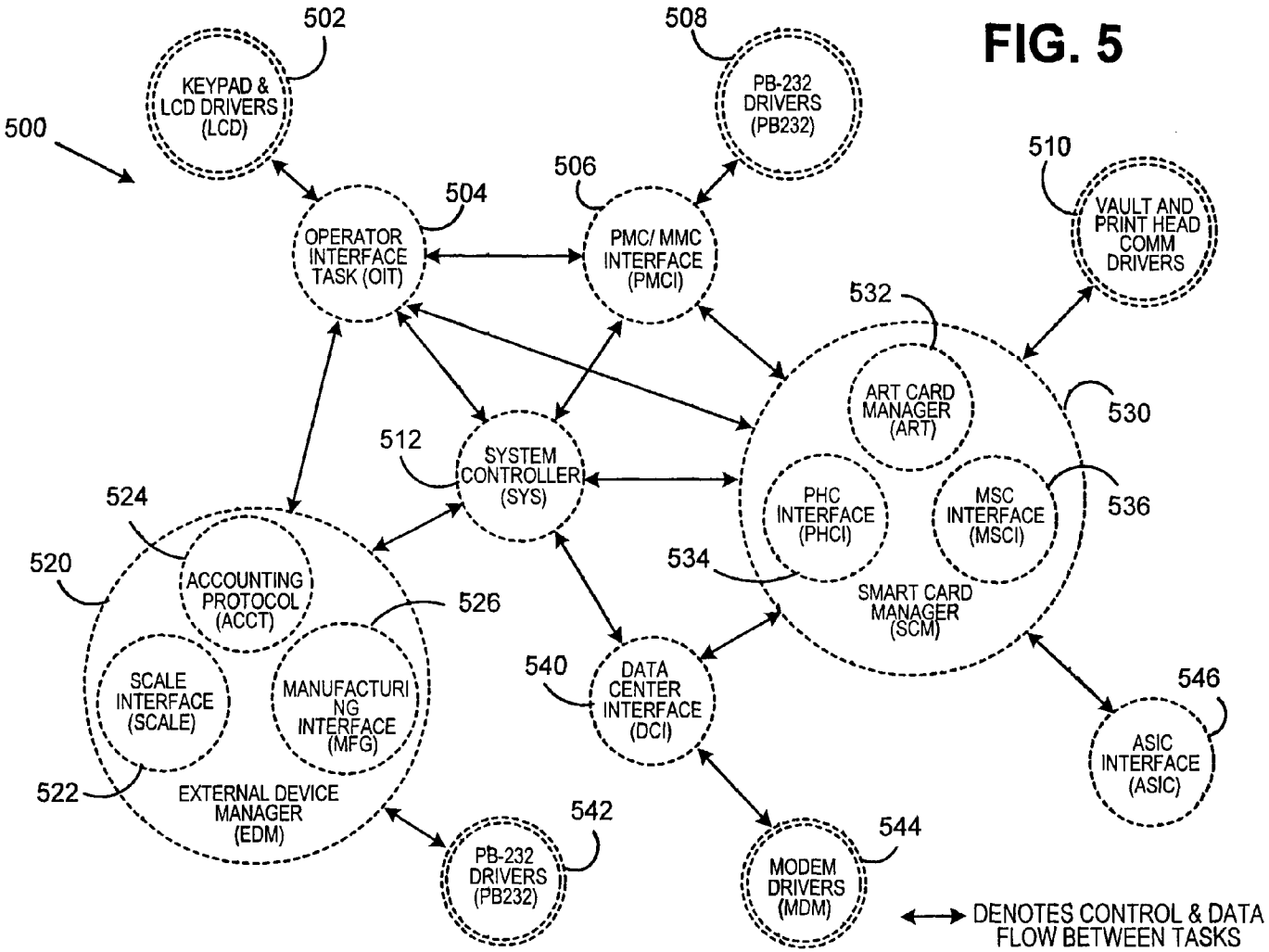
FIG. 5 is a block diagram illustrating a task structure of a value metering system for collecting meter usage data according to an illustrative embodiment of the present application.
Figure 6:
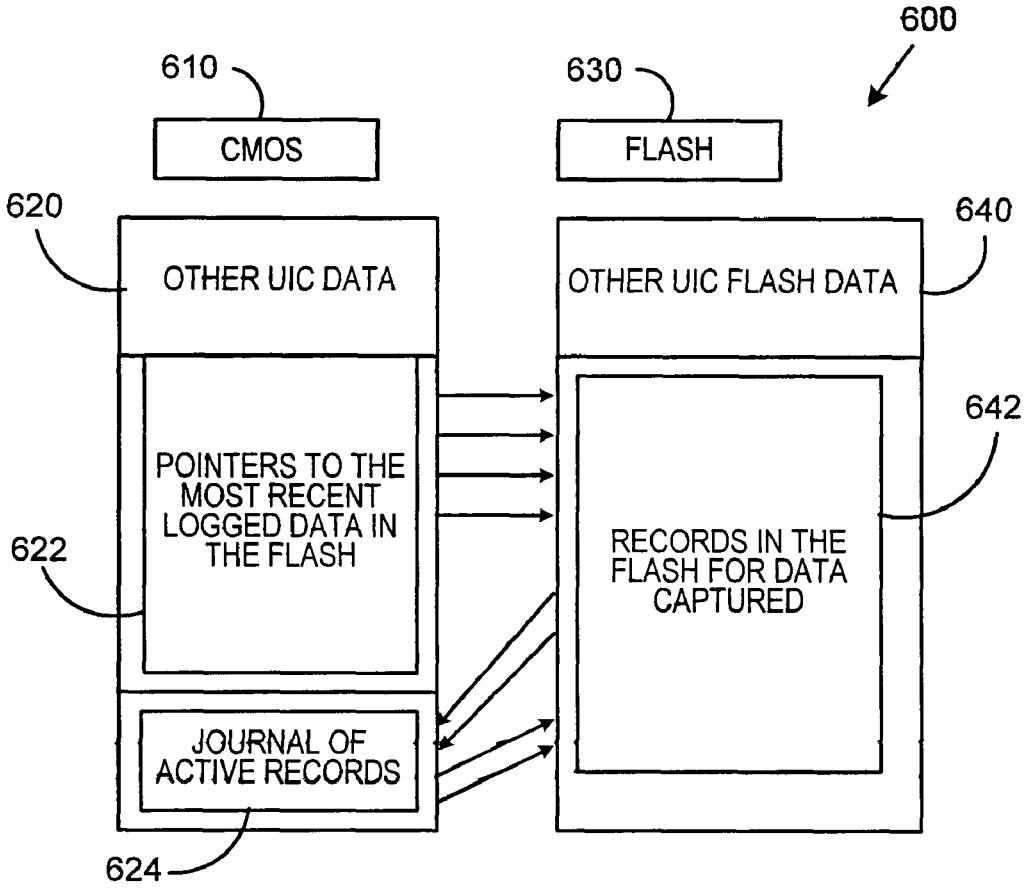
FIG. 6 is a block diagram illustrating a memory structure of a value metering system for collecting meter usage data according to an illustrative embodiment of the present application.

Referring to FIGS. 4-6, a value metering system including a system for capturing data regarding meter usage 400 is described. For example, the meter may meter postage values or other value such as tax stamps. In this embodiment, for illustrative purposes, a postage meter is described.

CMOS 415 is a Battery packed RAM memory used for non-volatile storage. An EIU is an External Interface Unit that is used by certain meters to provide additional functionality such as accounting features. A MMC is a Mailing Machine Controller and PPP is the Point-to-Point Protocol that is a standard protocol used by many modems when they dial out to and connect with another standalone modem. A UIC is a User Interface Controller and is also the main controller in the meter. A PMC is a Print Maintenance Controller and a Weigh on the Way (WOW) scale is a scale that weighs a mail piece as it is moving through the system.

The system uses a Data Driven Data Capture paradigm and the data capture function is data driven in the software. Several post offices have published specifications detailing the format of the data they wish to capture and other parameters such as the period of time that will go by before the data is sent to the post office. Other postal authorities have not yet published data capture specifications. The current embodiment provides a flexible system that is capable of being used with postal authorities that have varying requirements.

The system Rules are a set of rules are established to log the data. The rules take into account the type of mail that is being run by the customer. The rules determine which category a specific mail piece falls into and can include parameters such as postage, fee, class, and weight. Once a matching rule has been found, the appropriate data can be logged. In many cases, the data record is a counter that is incremented.

The Period Management system is used to manage the period of time that goes by before data is sent to the post office or data center. Other information may have to be logged at the end of a period. In addition, the software may be configured to keep data from multiple periods present in memory such as a NVRAM archive.

The Rates Management system is used to manage rates. The rates are commonly referred to in the rules. Therefore, rate changes may require rules changes. Furthermore, the rates may be stored in multiple areas and each rate area must be changed when the rates are updated. The rating engine will either be located in a scale or the UIC.

The Data Transfer system is used to transfer the data that is captured by the meter to a data center or a post office server. The most common transmission method will be through a modem 410. However, an Ethernet communications system 405 may also be utilized. The Ethernet communications channel may utilize appropriate standard protocols such as PPP and 10 Base T.

Triggers are events that can occur in the system and that affect data capture. Triggers include time, the number of mail pieces run and any other event that the software can detect. The triggers can be used to indicate when data should be sent from the meter to the data center. The triggers can also cause other data capture events to occur.

Several high-level system factors are now discussed. The first system factor considered is that multiple rating methodologies may be utilized by a meter. For example, scales systems may perform the rating function. In those systems, the scale supports a communications protocol that allows the transfer of the relevant data to the meter to be used in the data capture logging rules. Additionally, a WOW system can be used to weigh a mail piece as mail is running through the mailing machine. In those systems, the WOW system communicates information to the UIC that can be used in the rule evaluation process. In certain countries, an operator is able to enter data relating to the fee, class, and weight from the front panel user interface of the meter. In those situations, the manually entered information can also be used in the rule evaluation process.

The data may be logged in different storage medium such as flash, CMOS, or RAM memory devices. The system uses a Rule table update process in order to remotely update the rules table from the central data center. The system also uses a Record Structure so that the format of the information that is being logged is remotely accessible. The format of the information is commonly referred to a bucket system.

The system uses both upload and download formats when communicating with the remote processor. The format used with the upload and download message transfers is generic in order to allow record structure and rule table updates. The system uses Period Parameterization so that the period values may be remotely updated while the meter is installed at a customer location or otherwise located in the field.

A customer may print out a summary of the data or obtain a receipt once the period is over. The meter allows a customer to view the logged data, but does not allow a customer to change the data.

The system may also provide for security of the transferred data. For example, the UIC has the capability to send a message to the vault that will cause the vault to lock. The lock condition could be unlocked only if an appropriate secure message was received from the data center. Accordingly, the UIC may disable a vault if it detects a problem relating to the data.

Referring to FIG. 6, subsystems of the system for capturing data regarding meter usage 400 according to an illustrative embodiment of the application are described. The UIC Processor 460 is the microprocessor that executes the UIC software. It is a RISC based microprocessor. Alternatively, other appropriate processors may be used.

The vault 450 is the device that stores the funds for the meter. It is a secure processor and memory device. The vault 450 communicates funds related information to the UIC. The Real Time Clock 445 is a clock that is battery backed and keeps the date and time for the system.

The flash memory subsystem 440 includes at least one flash EEPROM device and is a non-volatile storage device that is used to store information including the images to be printed, the PCN parameters, and the UIC code. The Random Access Memory subsystem 425 (RAM) is volatile storage including a RAM device used for storing the UIC software when it is executing. The CMOS memory subsystem 415 includes battery backed, non-volatile RAM. The CMOS memory 415 is used by the UIC for parameter storage. An example of data stored in CMOS memory 415 is departmental accounting information.

The external PB232 port 435 is a port that may be connected to an external device such as a scale. The port uses a PB232 protocol that is somewhat similar to the standard RS232 standard serial port protocol. A USB subsystem 430 provides another serial port connection system. The Communications to Motion Control and Printer subsystem 420 is a series of ports that are used to communicate with the motion control and printing devices. These devices include separate processors and can receive commands sent by the UIC. The Modem 410 is a device that can send information across the telephone network to the Data Center. The Ethernet Connection subsystem 405 allows Ethernet and networking connectivity for the meter.

The Keyboard and Display subsystem 455 are used to retrieve customer input and communicate information to the user during use of the machine.

Referring to FIG. 5, the software system 500 of the system for capturing data regarding meter usage 400 according to an illustrative embodiment of the application are described. The meter software is organized into tasks that have queues and the queues can be used to receive messages. The meter software does not utilize time slicing and all tasks run at the same priority.

The System Controller task (SYS) 512 manages the state of the entire system and coordinates high level messaging between other major tasks to perform system functions. The SYS task 512 determines which system function is active at any time. A system state cannot be asserted without the system control being informed.

The Operator Interface task 504 (OIT) manages the interface between the user and the UIC. The OIT 504 task is responsible for interpreting key input, validating user input, and building screen output for display. It communicates with the Keypad and LCD Drivers task 502 (LCD) and manages the high level coordination between fonts, languages, and screens while the low level LCD driver (not shown) actually performs the display function.

The PMC/MMC Interface task 506 (PMCI) manages the interface between the UIC and the PMC. The PMCI task 506 communicates with PB232 drivers task 508. It tracks the mail piece through the system, sets up motion control parameters, manages the maintenance functions, handles jam recovery, and monitors the ink supply. The PMCI task 506 also contains diagnostic routines that exercise the PMC. Furthermore, the PMCI task 506 manages an interface to a MMC (mailing machine controller) if the functions were not contained in the PMC of a particular meter.

The External Device Manager task 520 (EDM) manages the external RS232 port and communicates with PB232 drivers 542. The EDM task 520 handles the manufacturing protocol messages using the Manufacturing Interface subtask 526 (MFG). Additionally, the EDM task 520 manages the scale class messages, and utilizes the Scale Interface subtask 522 (Scale). The EDM task manages the Accounting Protocol 524 (ACCT) and manages the diagnostic protocol and print head parameterization messages.

The Smart Card Manager task 530 (SCM) manages the high level messaging from the MSC, PHC, and art card. The SCM task 530 utilizes the Art Card Manager subtask 532 (ART), the PHC Interface subtask 534 (PHCI) and the MSC Interface subtask 536 (MSCI). The SCM task 530 controls the downloading of images to the print head ASIC and communicates with the Vault and Print Head Communications Drivers 510. The SCM task 530 is responsible for image downloading from an art card, debiting funds, sending print data to the PHC, parameterizing the PHC and MSC, and performing data retrieval from these devices. The SCM task 530 communicates with the meter ASIC using the ASIC Interface 546 (ASIC).

The Data Center Interface task 540 (DCI) manages the interface to the data center. A secure protocol is used to exchange information with the data center. The DCI task 540 works with modem tasks to send and receive data and communicates with Modem Drivers 544 (MDM). The DCI task 540 manages refills, remote inspection, and account balances.

Referring to FIG. 6, the non-volatile memory system 600 of the system for capturing data regarding meter usage 400 according to an illustrative embodiment of the application are described.

The system includes flash EEPROM NVM 630 and CMOS battery backed NVRAM 610. High Level Flash Services allow information to be retrieved from the flash subsystem. Images, PCN parameters, and report data are among the callable functions that exist in the high level flash services. Low Level Flash Services allow the flash to be written to in such a manner that it can recover if the power goes out. The Operating System function set is a set of wrapper functions that can be called to access the operating system features.

The Batch Registers function set implement the batch register functionality. Ads/Inscriptions is a function set that allows the caller to access all data relevant to ads and inscriptions. The Reports system is a set of driver routines that populate a report with data. The Conversion Utilities system is a set of Unicode, ASCII, packed BCD, BCD, and monetary conversion functions that may be called. The CMOS function set is a set of routines that allow the battery backed RAM to be accessed. While the data that is captured is typically stored in non-volatile memory, it is also possible to store it in RAM. Accordingly, the meter is configured to set which storage medium it will use for the data.

The most common algorithm used by the meter share data between the CMOS 610 and the flash 630. The CMOS 610 contains a journal of active records 624. The records 624 contain the data that is logged with each transaction. The number of records that can be stored in the CMOS will depend on the available memory. A typical 128K byte CMOS part contains enough storage space to store all of the data for a typical period. Once the period is complete, the record set can be written into the flash for archival. A pointer 622 to the records can be kept in the CMOS. The CMOS may also be used to store other UIC data 620.

If the CMOS 610 cannot store an entire period, then it will store a fixed set of records. When the CMOS 610 is full, the data will be transferred into the flash in order to make CMOS storage space available to continue. Once again, the CMOS 610 will contain a set of pointers to the records in the flash 630. The flash system stores Data Capture Records 642 and also stores Other UIC Data 640.

When a record is being journaled in the CMOS 610, the most recent copy of the record is looked up through a CMOS pointer 622 and retrieved out of the flash 630. When the transaction is complete or the CMOS 610 is full, the software will invalidate the previous record in the flash by toggling a bit, write the new record from the journal to the next available location in the flash, and adjust the pointer 622 in the CMOS to the new location.

Obviously, if the CMOS 610 can store an entire period, the copying between the CMOS and flash is done infrequently. All of the pointers 622 are updated after the flash archival is complete.

The system provides for error detection during the backup process. The flash sectors used for data capture will have one three states. The flash sector state can be unused by data capture, have a valid data capture record, or have an invalid data capture record. The record is invalid when the bit is toggled during the copying process discussed above.

If the flash 630 becomes full and the data has not been transmitted, the meter can attempt a garbage collection cycle. There may be sectors of the flash or records that are no longer needed. If this is true, the meter can compact the flash and keep only the current records present in it. However, it is still possible that the meter will not be able to clear this condition because of a large amount of logged data. If the flash full condition cannot be cleared, the meter must not allow new indicia to be printed until the data is uploaded and flash memory is made available.

When a flash archive 642 is updated, the CMOS pointers 622 are adjusted to point to the latest set of records. The flash archive process should be done as infrequently as possible because of the limited number of write cycles available on a flash part. It may be necessary to limit the number of Ads and Inscriptions that can be loaded into the Other UIC Data 640 section of the flash 630 because of the memory requirements for data capture.

If the power fails while the UIC is performing a flash operation, the UIC will have backed up the information in a sector of the flash. Based on this information, the UIC will be able to restore the flash and continue its operation. There is also an algorithm in the EIU that can be used if the power fails while writing to the CMOS. This algorithm uses the registers of the meter and some non-volatile data to adjust the logged information correctly. The storage medium is installed in a socket on the board. This will allow the memory device to be removed and placed into another UIC.

The data capture software uses the Rules to determine the bucket that the data will be logged into. The information is typically received from a rating engine. The inputs parameters used by the Rules include: Bucket Names, Carrier, Class (Base Rate), End of Period List, Fee (N Rates per class), Fee Value (1 Fee value per fee), Discount Surcharge, Monetary Add, Weight, Total Value, Piece Count, Weight Break Table, and Zone (Destination). Multiple rules can update multiple buckets beyond the master token bucket and the following operations can be conducted to develop a rule: Equal to, Greater than, Less than, Greater than or equal to, Less than or equal to, And operations, OR operations, and Not operations.

Therefore, an example rules could be Fee equals $1.00 and Weight=5 lb. Another example Rule could state Carrier equals USPS and $4.00<=Discount Surcharge<=$5.00.

The output of the rules is an identifier of the bucket that the data should be stored in. The bucket will typically contain a counter that must be updated when a rule is found to be true. The bucket may also capture the most recent value of some other piece of data. It is also possible to utilize a default rule that will execute if no other rule is found to be true. This would allow the data that did not match any rule to be logged.

The rules are typically based on system events. A message from the scale indicating a change in the input can cause the rules to execute. A new weight from the WOW system or information from the front panel could also cause the rules to execute. Typically, the rules will not change during a run of mail pieces. They will change with the high level state of the machine.

Several triggers can be implemented using the rules. A pre-trigger is a set of rules that causes an event to happen if several events are true. These triggers can best be implemented by the first set of rules that the software executes. A post-set of rules can be executed after all the buckets have been updated. This can cause another event to occur after the buckets have been updated. An example of a post trigger event and reaction could be to send the data through an Ethernet port if a specific class or fee was detected.

The rules are table driven. Software functions are provided to parse and evaluate the rules. The rules table is placed in the UIC CMOS or flash so that it can be updated by the data center. The data capture rule software is a new set of services that the UIC system control task 512 SYS will call. The system control task 512 calls the rules table functionality because it knows the high-level system state. The System Controller can easily determine when a new rule evaluation is required.

The Period Management system is an element of data capture because it determines when data must be sent to the data center. There are also other events that occur during a period. One example of an event is a daily or weekly log that is required by certain countries. These logs can snapshot data when a certain period of time is done. The French postal authority Ascending register log requirement is an example of this application.

Several other parameters may be used in a period management system. These parameters include the Date and Time of upload that specifies when should the upload occur. The parameters also include Automatic Dialing out Enabled that specifies whether the customer has to initiate the sending of the data or if the machine will do it without intervention. The Retries parameter indicates how many times and how often the data should be retransmitted if it is not received by the data center. The Number of stored periods allowed parameter indicates the number of periods that can be stored in the machine. The Grace Period parameter indicates the time period that a customer can still run mail after failing to send when expected. Similarly, other triggers may be used to send the data and period management will have to take these into account.

The rates may cause a rule change in the data that is logged. Therefore, the rules table and rates table are synchronized. The rates table could be in the UIC or in the scale and the data center is used to verify that the correct versions are present.

The data center performs a run-time compatibility check between the rules table and rates table when one of them changes. If the rates are located in the UIC, then the UIC can power up, detect a new rate table and immediately have the SYS task 512 inform the DCI task 540 after power up to call the data center to pass the versions of the tables to it.

If a scale is attached, the EDM task 520 will detect it. Upon detection of the scale, the EDM task 520 will retrieve the rates table version and determine whether is has changed. It can then inform the system controller that there is a new rate table. The SYS task 512 can then tell the DCI task 540 to call the data center to perform the compatibility check.

The data center will download new rules to the UIC if it detects that the rules and rates will not work together. The DCI task 540 will receive the data and write it into the CMOS or flash if an update is required.

In an alternative embodiment, the system accommodates the several post offices using data capture that would like the UIC to log data for only a single serial number. In those systems, the UIC can only work with a single vault because the vault contains the serial number. Accordingly, a PCN parameter indicates if this marriage is required. The so-called marriage ceremony is conducted by the UIC's SCM task 530. This task will read the vault serial number on power-up during the out-of-box mode and record the serial number in the CMOS. On subsequent session initializations and power-ups, the SCM task 530 will check to make certain the correct serial number is still attached. This check is only required when the UIC is plugged into the base.

The present application describes illustrative embodiments of a system and method for transferring postage meter data. The embodiments are illustrative and not intended to present an exhaustive list of possible configurations. Where alternative elements are described, they are understood to fully describe alternative embodiments without repeating common elements whether or not expressly stated to so relate. Similarly, alternatives described for elements used in more than one embodiment are understood to describe alternative embodiments for each of the described embodiments having that element.

The described embodiments are illustrative and the above description may indicate to those skilled in the art additional ways in which the principles of this invention may be used without departing from the spirit of the invention. Accordingly, the scope of each of the claims is not to be limited by the particular embodiments described.

The invention claimed is:

1. A method for collecting a first set of usage data and a second set of usage data for a postage meter including a controller, a memory, and an interface, comprising:

storing, by the controller of the postage meter, the first set of usage data in the memory in accordance with a first set of data collection segregation rules;

receiving, by the controller of the postage meter, an update of the first set of data collection segregation rules;

processing, by the controller of the postage meter, the update of the first set of data collection segregation rules before collecting the second set of usage data, wherein processing the update includes obtaining a second set of data collection segregation rules; and reformatting, by the controller of the postage meter, the first set of usage data in accordance with the second set of data collection segregation rules;

wherein the first set of data collection segregation rules and the second set of data collection segregation rules each describe categories to which metered mail pieces are to be logged as belonging.

2. The method of claim 1 wherein:

the first set of data collection segregation rules and the second set of data collection segregation rules each comprise a text string used for printing data capture information in a meter indicium.

3. The method of claim 1, wherein the memory is a non-volatile memory.

4. The method of claim 1, wherein the first set of usage data and the second set of usage data have fields to which XML tags are assigned.

5. The method of claim 1 wherein:

the first set of data collection segregation rules and the second set of data collection segregation rules provide for collection of data to differentiate transactions processed using automated rating and transactions processed using manual rating.

6. The method of claim 5 wherein:

manual rating comprises keypad data entry; and automated rating comprises automatically weighing mail pieces.

7. The method of claim 1 further comprising:

aggregating transaction records into a data report.

8. The method of claim 7 further comprising:

determining a unique identifier for the data report.

9. The method of claim 8 further comprising:

transmitting the data report and the unique identifier to a central server.

10. A postage meter for collecting a first set of usage data and a second set of usage data, comprising:

a processor; and a memory, communicatively coupled to the processor;

wherein the processor is configured to perform a method comprising:

storing the first set of usage data of the postage meter in the memory in accordance with a first set of data collection segregation rules;

receiving an update of the first set of data collection segregation rules;

processing the update of the first set of data collection segregation rules before collecting the second set of usage data of the postage meter, wherein processing the update includes obtaining a second set of data collection segregation rules; and reformatting the first set of usage data of the postage meter in accordance with the second set of data collection segregation rules;

wherein the first set of data collection segregation rules and the second set of data collection segregation rules each describe categories to which metered mail pieces are to be logged as belonging.

* * * * *